United States Patent [19]

Bertling et al.

[11] 4,144,858

[45] Mar. 20, 1979

[54] FUEL SUPPLY APPARATUS FOR AN INTERNAL COMBUSTION ENGINE

[75] Inventors: Johannes-Gerhard Bertling, Vaihingenan der Enz; Werner Schiele, Ludwigsburg, both of Fed. Rep. of Germany

[73] Assignee: Robert Bosch GmbH, Stuttgart, Fed. Rep. of Germany

[21] Appl. No.: 792,738

[22] Filed: May 2, 1977

[30] Foreign Application Priority Data

May 8, 1976 [DE] Fed. Rep. of Germany ..... 2620385

[51] Int. Cl.[2] ..... F02M 69/00

[52] U.S. Cl. ..... 123/139 AW; 123/139 E; 261/36 A; 261/DIG. 74

[58] Field of Search .... 123/139 AW, 119 R, 119 EC, 123/139 E; 261/36 A, DIG. 74, 63, 39 D

[56] References Cited

U.S. PATENT DOCUMENTS

| | | | |
|---|---|---|---|
| 3,395,899 | 8/1968 | Kopa | 123/119 R X |
| 3,650,258 | 3/1972 | Jackson | 123/139 AW |
| 3,690,305 | 9/1972 | Shimada et al. | 123/119 EC X |
| 3,967,607 | 7/1976 | Eckert | 123/119 R X |
| 3,981,288 | 9/1976 | Wessel | 123/139 AW |
| 3,983,848 | 10/1976 | Handtmann et al. | 123/32 EA |
| 3,994,267 | 11/1976 | Eisele et al. | 123/139 A W X |

*Primary Examiner*—Charles J. Myhre
*Assistant Examiner*—Tony M. Argenbright
*Attorney, Agent, or Firm*—Edwin E. Greigg

[57] ABSTRACT

A fuel supply apparatus for an internal combustion engine in which fuel is supplied to the air induction tube in proportion to the aspirated air flow rate. A fuel metering valve, which may be electromagnetically actuated on the basis of engine rpm and other variables, is connected to the induction tube, possibly into the bypass channel of a carburetor to provide fine fuel control. Between the fuel metering valve and the induction tube there is disposed a pneumatic valve assembly including an equal pressure valve, the pressure chamber of which controls the fuel flow and the control chamber of which is coupled to the pressure chamber of a further, differentially-biased pressure control valve connected to downstream portions of the induction tube. The differential pressure valve maintains the control pressure in the equal pressure valve.

8 Claims, 1 Drawing Figure

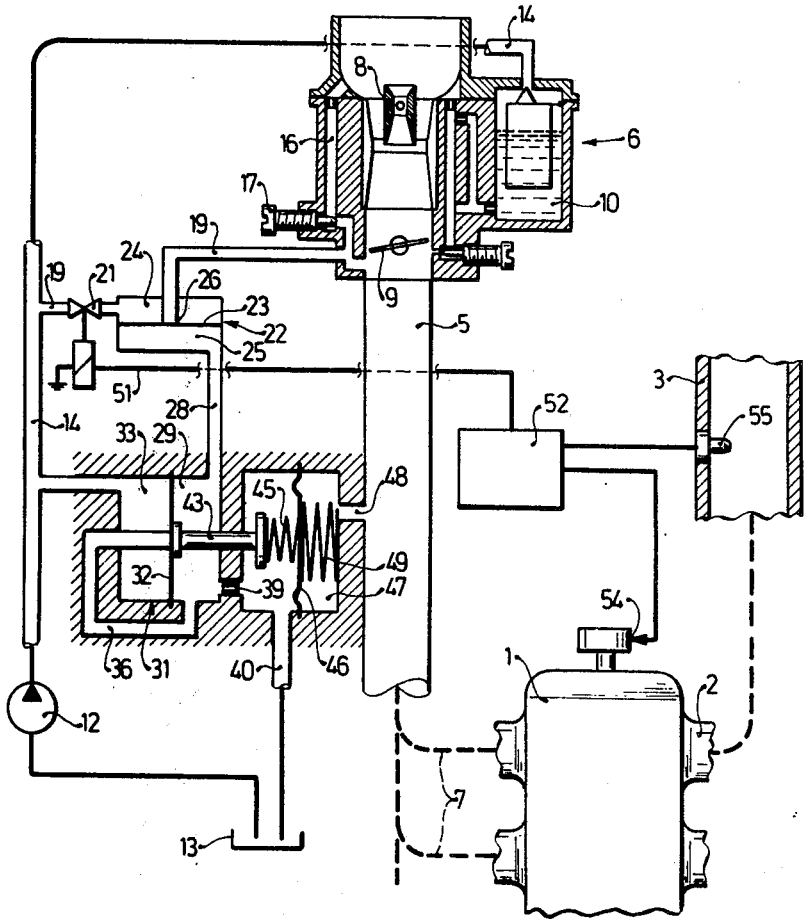
14
8
6
16
10
17
19
24
19
21
26
23
22
25
9
5
51
28
14
33
29
3
52
55
48
45
43
49
47
32
39
54
1
36
31
40
46
2
12
7
13

FUEL SUPPLY APPARATUS FOR AN INTERNAL COMBUSTION ENGINE

BACKGROUND OF THE INVENTION

The invention relates to a control system for supplying fuel to the induction manifold of an internal combustion engine. The apparatus includes a fuel metering valve for supplying fuel from a fuel supply line to the induction tube of the engine via a control device and in dependence on an operational variable related to the exhaust gas composition as well as in dependence on rpm. The system also includes a pressure control device associated with the fuel metering valve and itself controlled by the pressure upstream of an arbitrarily settable throttle valve in the induction manifold.

In a known apparatus which includes a pressure control valve the closure member of which is in a fuel line leading to the induction tube, the fuel pressure between this valve closure member and a downstream metering valve is controlled in dependence on the induction tube pressure.

This pressure may be corrected corresponding to the fuel pressure prevailing in the fuel line downstream of the metering valve. The closure element of the pressure control valve is engaged by two elements one of which experiences the induction tube vacuum as well as atmospheric pressure and the force of a spring tending to open the valve whereas the other element experiences the fuel pressure upstream and downstream of the metering valve.

This known system has the disadvantage that the functional connection between the metered out fuel flow and the actually required fuel flow cannot even be approximately maintained correctly because the relationship between the induction tube pressure and the required fuel flow at constant rpm is linear, whereas the pressure difference across the metering valve which is proportional to the induction tube pressure results in a quadratic relation between induction tube pressure and fuel flow.

Furthermore, it is an inherent disadvantage of the known apparatus that fuel is injected into the induction tube through a spring loaded injection nozzle. Thus the pressure between the fuel pump and the carburetor has to attain a minimum given by the sum of the injection pressure of the injection nozzle, the maximum pressure difference across the metering valve and the pressure drop in the pressure control valve for maximum fuel flow and this pressure may reach substantial magnitudes. A normal fuel supply pump would not suffice to provide the required power and must be replaced by a larger, more expensive pump.

OBJECT AND SUMMARY OF THE INVENTION

It is a principal object of the invention to provide a fuel control system which does not have the above-described inherent disadvantages of the known apparatus and which permits a precise metering of a required fuel quantity into the induction manifold of an internal combustion engine.

This and other objects are attained according to the invention by providing an equal pressure valve in the fuel line downstream of the fuel metering valve. The invention further provides that the pressure controller is a differential pressure valve controlling a relief line and that the pressure adjusted by the differential pressure valve is used to control the equal pressure valve.

The disposition of these elements brings the advantage that an equal pressure valve is disposed between the metering cross section of the fuel metering valve and the induction tube, thereby preventing any reverse affect of the induction tube pressure on the metering cross section of the fuel metering valve. At the same time, the presence of the differential pressure valve insures an adjustable constant pressure drop across the fuel metering valve which is independent of the fuel flow rate.

A preferred embodiment of the invention provides that the differential pressure valve has a closure member which is engaged in the closing direction by a force proportional to the square of the induction tube vacuum. The closure member is engaged on both sides by the pressure to be controlled and an overflow cross section of a relief line which branches off from a fuel supply line upstream of the metering valve is controlled by the closure member of the differential pressure valve. The relief line leads to the pressure chamber of the differential pressure valve which is connected to the equal pressure valve and which is pressure relieved via a throttle bore. This disposition brings the advantage that the pressure drop which is set at the flow cross section of the fuel metering valve is substantially independent of the fluctuating fuel pressure supplied to the metering valve. At the same time, the pressure supplied to the equal pressure valve may be changed in dependence on the induction tube pressure. This produces a direct dependence of the supply fuel quantity on the induction tube vacuum. An additional independent change of the supplied fuel quantity may be obtained by directly controlling the metering valve.

A further advantageous feature of the invention is that a carburetor has a bypass channel for air into which the fuel line terminates. This produces a good preparation of additional fuel supplied to the engine. Advantageously, the carburetor is set to supply an operational mixture having a coarsely adjusted mixture ratio, whereas the supply of additional fuel produces a precisely regulated overall operational mixture. This system produces a rapid and multiplicative control of the operational mixture of the engine.

The invention will be better understood as well as further objects and advantages thereof become more apparent from the ensuing detailed description of a preferrred embodiment taken in conjunction with the drawing.

BRIEF DESCRIPTION OF THE DRAWING

The single FIGURE of the drawing is a partially sectional and partially schematic illustration of a fuel control system according to the invention.

DESCRIPTION OF THE PREFERRED EMBODIMENT

Turning now to the single FIGURE, there is illustrated a portion of an internal combustion engine 1 having a schematically indicated exhaust gas system 2, a portion 3 of which is shown enlarged. The internal combustion engine has an induction tube 5, the inlet of which includes a carburetor 6 which supplies the engine with an operational fuel-air mixture through the induction manifold 7. In known manner, the carburetor has an air funnel 8 and downstream thereof an arbitarily settable throttle butterfly valve 9. A float chamber 10 supplies fuel in the vicinity of the narrowest portion of the air funnel 8 in proportion to the air flow rate through the induction tube. Fuel is supplied to the float chamber by a fuel pump 12 from a fuel supply container 13 through a fuel supply line 14.

The carburetor 6 includes a bypass air channel 16 which branches off from the induction tube upstream of the air funnel 8 and which returns to the induction tube downstream of the throttle valve 9. The flow cross section of the bypass channel can be varied by means of an adjustment screw 17. The air bypass channel is of the type commonly supplied in carburetors of modern construction and serves to adjust the idling of the engine. It may be disposed as illustrated, i.e., as a bypass around the throttle valve 9 and the air funnel 8 or as a bypass only of the throttle valve. Terminating in the bypass air channel is a fuel line 19 which branches off from the main fuel supply line 14 and which contains a fuel metering valve 21. The flow through the fuel line 19 is controlled by an equal pressure control valve 22 which is disposed between the fuel metering valve 21 and the terminus of the line 19 in the bypass channel 16. The equal pressure valve 22 has a firmly clamped elastic diaphragm 23 which divides the valve into a pressure chamber 24 and a control chamber 25. The fuel line 19 terminates in the pressure chamber 24. The portion of the fuel line 19 leading to the bypass channel 16 enters the pressure chamber 24 at right angles and its terminus is embodied as a valve seat 26 which cooperates with the diaphragm 23 to form a valve.

A short line 28 connects the control chamber 25 with a pressure control chamber 29 of a differential pressure valve 31. The closure member of the latter is a firmly clamped elastic diaphragm 32 which separates the pressure control chamber 29 from a working chamber 33 which is coupled to the fuel line 14. A relief line 36 extends into the working chamber 33 and meets the diaphragm at right angles where its terminus is thus controlled by the position of the diaphragm 32. From this point, the relief line 36 leads to the pressure control chamber 29 which is pressure-relieved through a throttle bore 39 and a return line 40 leading to the fuel container 13. Entering the control pressure chamber 29 in pressure sealed manner is an actuating rod 43, one end of which is coupled to the diaphragm 32 and the other end of which is engaged by a first spring 45 having a progressively increasing force characteristic and which is supported on a diaphragm 46. The opposite side of the diaphragm 46 encloses a vacuum chamber 47 which is coupled via channel 48 with the induction tube 5 downstream of the throttle valve 9. If the actuating rod is guided with free tolerance, a throttle bore 39 may be dispensed with. The vacuum chamber 47 also contains a second spring 49 disposed between the diaphragm and the opposite side of the chamber. The metering valve 21 in the fuel line 19 is an electromagnetic valve acting as a switching valve having an "on" and an "off" position. A controller 52 actuates the valve 21 via a line 51 and the controller receives its information from an rpm transducer 54, of known construction, which senses the rotational speed of the engine, for example at the crankshaft, and also, for example, by a known oxygen sensor 55 disposed within the portion 3 of the exhaust gas system 2.

The above-described apparatus operates in the following manner:

When the internal combustion engine is running, the fuel pump 12 supplies fuel from the container 13 to the float chamber 10 of the carburetor 6. In known manner, the carburetor produces a fuel-air mixture of predetermined composition and delivers it to the induction tube 5 of the engine. The amount of mixture is set by the position of the throttle valve. In addition hereto, an amount of fuel controlled by the metering valve 21 is supplied through the fuel line 19 to the bypass air channel and hence into the induction tube. This additional fuel quantity is also taken from the fuel line 14 and its magnitude depends on the opening flow cross section of the metering valve, the opening duration of which, together with the pressure difference across it, determines the fuel flow through that line. The pressure difference across the metering valve 21 is determined by the fuel pressure prevailing upstream of the valve in the line 19 and by the controlled pressure in the pressure chamber 24 of the equal pressure valve 22. The pressure upstream of the metering valve is the same as the pressure in the working chamber 33 of the differential pressure valve and also equal to the fuel pressure generated by the fuel pump 12 in the line 14. The pressure in the chamber 24 of the equal pressure valve 22, however, is determined by the pressure prevailing in the control pressure chamber 25. As sonn as the pressure in the chamber 24 exceeds that in the chamber 25, the diaphragm 23 opens the valve seat 26 so that fuel may flow through the valve 21 and the fuel line 19. In order to function in this manner, the pressure in the control chamber 25 must be lower than the pressure in the fuel supply line 14 and it is determined by the differential pressure valve 31.

If the force acting on the diaphragm 32 is assumed to be constant, the diaphragm 32 will open the relief line 36 as soon as the pressure in the control pressure chamber 29 has fallen below a value which is less than the pressure prevailing in the work chamber 33 due to the continuous flow of fuel through the throttle bore 39 back to the storage container 13. The magnitude of the pressure difference is determined by the force which acts on the diaphragm 32. However, as soon as the relief line 36 is opened, a larger amount of fuel flows into the control pressure chamber 29 so that the pressure there again reaches the previously adjusted value. Accordingly, the control chamber 29 may be provided with a pressure which is less than the pressure in the chamber 33 or the pressure upstream of the metering valve 21 by a definite amount. The pressure in the chamber 24 of the equal pressure valve is the same as that in the pressure chamber 29 or in the control pressure chamber 25. This insures that the same pressure difference always obtains across the free flow cross section of the metering valve.

This pressure difference, however, may also be varied in dependence on the pressure in the induction tube 5 by changing the force which acts on the diaphragm 32, i.e., by changing the bias on the diaphragm. For this purpose, the diaphragm 46 in the vacuum chamber 47 is displaced in proportion to the induction tube pressure and against the force of the second spring. This produces a displacement which is proportional to the induction tube pressure and which changes the bias of the first spring 45. This spring preferably has a progressive force characteristic so that the force of this spring becomes proportional to the square of the induction tube pressure and is transmitted to the diaphragm 32. It is this force to which the pressure difference between the pressure in the working chamber 33 and that of the control pressure chamber 29 is proportional. Accordingly, the pressure difference adjusted across the metering cross section of the fuel metering valve 21 is proportional to the square of the induction tube pressure. In order to insure satisfactory and rapid action of the various elements, the communicating lines between the control pressure chamber 25 and the pressure chamber 29 as well as between the working chamber 33 and the upstream side of the metering valve 21 are kept as short as possible so as to reduce throttling effects and thereby to prevent large deviations of the pressures at the metering valve from the pressure difference set by the differential pressure valve.

As already mentioned, the metering valve is actuated by a control device 52. The latter causes cyclic actuation of the valve by means of control pulses of variable width and of rpm-dependent frequency. An rpm transducer 54 senses the prevailing engine speed. The variation of the pulse width takes place in dependence on an operational parameter, for example the exhaust gas composition. For this purpose, the control device 52 receives signals from a per se known oxygen sensor 55 which responds to different oxygen partial pressures and which generates an abrupt signal in the transition from an excess of oxygen to a shortage of oxygen in the exhaust gas at a point where the air factor $\lambda = 1$. In known manner, the pulse width of the fuel control pulses generated by the control device 52 is changed on the basis of the oxygen sensor signal.

The above-described apparatus provides fuel into the induction tube in direct proportion to the air flow rate through the induction tube. This will be understood from the consideration that the aspirated air flow rate is proportional to the induction tube pressure and to the engine speed (rpm). However, the flow cross section of the metering valve 21 is also made proportional to the engine rpm. This is done by providing valve-opening control pulses at an rpm-dependent frequency, with the pulse width assumed constant for the time being. In the same manner in which the aspirated air quantity is proportional to the induction tube pressure, the pressure difference at the fuel metering cross section is such that its square root is proportional to the induction tube pressure. This is done, as described, by varying the force exerted on the diaphragm 32 of the differential pressure valve 31. Thus, the fuel quantity which is provided in proportion to the aspirated air flow rate can be influenced in accordance with the magnitude of an operational variable of the engine by changing the width of the control pulses in a multiplicative manner. In the present exemplary embodiment, this is done by using the oxygen sensor output voltage. However, the process could be performed by using other operational parameters, which have an influence on the exhaust gas composition. This could be, for example, in particular, the control variable of a per se known control process based on engine speed fluctuations. If the rpm signal is superimposed on the processed signal of, for example, the oxygen sensor, a continuous analog adjustment of the flow cross section at the fuel metering valve 21 may also be performed with a similar result. Furthermore, the entire fuel supply of the engine may take place solely by means of the fuel metering valve 21.

Advantageously, the fuel line 19 terminates in a bypass channel 16 associated with the carburetor 6. In this way, even relatively low flow rates result in high air speeds which guarantee adequate preparation of the fuel in the fuel-air mixture. The apparatus described here can be adapted in simple manner as a supplementary device to an already existing carburetor system. It offers a wide control domain and a high degree of effectiveness in all load and speed regions of the engine.

The foregoing relates to preferred exemplary embodiments of the invention, it being understood that other embodiments and variants are possible within the spirit and scope of the invention.

What is claimed is:

1. A fuel supply apparatus for an internal combustion engine, said engine having an air induction tube containing an externally settable throttle valve; and said apparatus including fuel metering means for supplying fuel to said induction tube, said fuel metering means comprising an electromagnetic valve, control means for controlling the amount of fuel supplied by said metering means, said control means being arranged to provide electric control pulses to said fuel metering means the frequency of which is dependent on engine speed (rpm), and pressure operated flow control means for gauging the pressure in said induction tube downstream of said throttle valve and for providing a further control of the flow of fuel supplied to said induction tube, the improvement in said apparatus comprising:

said pressure operated flow control means includes a bicameral equal pressure valve having a control chamber and a valve chamber for providing said further control of the flow of fuel; and a differential pressure valve for controlling the pressure in said control chamber of said bicameral equal pressure valve.

2. A fuel supply apparatus as defined by claim 1, including a main fuel conduit and wherein said differential pressure valve has a control chamber connected to said induction tube, a first pressure chamber connected to said control chamber of said bicameral equal pressure valve and return valve means for providing variable fuel flow from said main fuel supply conduit to said first pressure chamber, and means including a throttle for connecting said first pressure chamber to a region of low fuel pressure; whereby the net closing force on said return valve means is a function of the pressure in said induction tube.

3. A fuel supply apparatus as defined by claim 2, wherein said fuel supplied to said induction tube is supplied thereto downstream of said throttle valve.

4. A fuel supply apparatus as defined by claim 3, wherein the width of said pulses is dependent on a parameter characterizing the composition of the exhaust gas of the engine.

5. A fuel supply apparatus as defined by claim 2, wherein said induction tube has a carburetor and an air bypass channel therefor, and wherein the fuel supplied to said induction tube is supplied to said bypass channel.

6. A fuel supply apparatus as defined by claim 5, wherein the width of said pulses is dependent on a parameter characterizing the composition of the exhaust gas of the engine.

7. A fuel supply apparatus as defined by claim 1, including a main fuel conduit and wherein said differential pressure valve has a control chamber connected to said induction tube, a first pressure chamber connected to said control chamber of said bicameral equal pressure valve and return valve means for providing variable fuel flow from said main fuel supply conduit to said first pressure chamber, and means including a throttle for connecting said first pressure chamber to a region of low fuel pressure;

and wherein the valve closing member of said return valve means is a secondary diaphragm defining said first pressure chamber and a second pressure chamber, an actuating rod for actuating said secondary diaphragm in the closing sense of said return flow valve, a spring for urging said actuating rod in said closing sense and wherein said differential pressure valve has a main diaphragm defining said control chamber connected to said induction tube, said control chamber including biasing spring means for biasing said main diaphragm and wherein said main diaphragm supports said spring which exerts force on said secondary diaphragm.

8. A fuel supply apparatus as defined by claim 7, wherein said spring provides a progressively increasing force as a function of compression.

* * * * *